US008167734B2

(12) United States Patent
Boldin

(10) Patent No.: US 8,167,734 B2
(45) Date of Patent: May 1, 2012

(54) GOLF SWING TRAINING DEVICE

(76) Inventor: Alexander Boldin, Kempten (DE)

( * ) Notice: Subject to any disclaimer, the term of this patent is extended or adjusted under 35 U.S.C. 154(b) by 98 days.

(21) Appl. No.: 12/832,089

(22) Filed: Jul. 8, 2010

(65) Prior Publication Data

US 2011/0009204 A1 Jan. 13, 2011

(30) Foreign Application Priority Data

Jul. 9, 2009 (DE) ..... 20 2009 009 416 U

(51) Int. Cl.
*A63B 69/36* (2006.01)

(52) U.S. Cl. ..... 473/229; 473/219; 473/257

(58) Field of Classification Search ..... 473/219, 473/226, 229, 257, 258, 261, 266, 270
See application file for complete search history.

(56) References Cited

U.S. PATENT DOCUMENTS 3,703,294 A * 11/1972 Fitch ..... 473/229
5,050,885 A * 9/1991 Ballard et al. ..... 473/216
5,242,344 A * 9/1993 Hundley ..... 482/93
5,984,797 A * 11/1999 Kessler et al. ..... 473/216
6,413,196 B1 * 7/2002 Crowson ..... 482/118
6,431,991 B1 * 8/2002 Kossnar et al. ..... 473/216
7,048,638 B2 * 5/2006 Novotny ..... 473/219
7,806,780 B1 * 10/2010 Plunkett ..... 473/257

* cited by examiner

*Primary Examiner* — Nini Legesse
(74) *Attorney, Agent, or Firm* — Mesmer & Deleault, PLLC

(57) ABSTRACT

A swing training device includes a guiding-arm and a resistance-arm that guides a user through a backswing and a forward swing allowing a user to hit a ball with a naturally swinging follow-through without any hindrance from the guiding components. Two computer-controlled electric motors provide rotation of the corresponding arms. The speed of rotation of the guiding-arm defines a pace of golf club movements. The speed of rotation of the resistance-arm defines the position of the club shaft relative to the user's forearms at each point of the backswing. During the forward swing the resistance-arm defines a pace of golf club movements, while the guiding-arm interactively resists the golf club movements through the guiding-arm lead, which is released from the guiding-arm by means of a trigger mechanism mounted on the distal end of the guiding-arm at a defined point of the swing controlled by the computer system a golf club.

20 Claims, 11 Drawing Sheets

EDGE ACADEMIC COPY

GOLF SWING TRAINING DEVICE

This application claims benefit the benefit of German Patent Application No. 20 2009 009 416.2, filed Jul. 9, 2009.

BACKGROUND OF THE INVENTION

The present invention relates to a training device designed for teaching a user to master a golf swing and more specifically to a device that provides the guiding components for interactive and passive guiding a golf club throughout a training swing by a user from a waiting stance up to an end of a backswing, and through a forward swing up to a ball impact zone, and that allows a user to hit a ball without any hindrance from the guiding components by naturally swinging follow-though.

The present invention relates to a guiding device or "guidance system" that interactively and passively guides a user throughout a golf training swing. The term a "guidance system" refers to any type of visual or kinesthetic training aid that literally guides a player's behavior. The word kinesthetic in relation to sports training indicates something, which is felt or perceived physically while it is experienced. This means that if users can experience physically (kinesthetically) what its like to swing the golf club through the assistance of a golf swing guiding device, they will then be able to repeat that feeling under real conditions.

The term "interactive guiding" refers to a guiding component, which defines interactively the pace or rhythm of the movement, as a "passive guiding" component defines positioning of the golf club shaft, correspondingly the user's wrists positions, relative to the user's forearms along the golf swing trajectory at each interactive moment of the training swing. The guiding components are a guiding-arm, a short lead thereof connected to the distal end of a golf club tows interactively the club shaft up to the end of the backswing, and a resistance-arm, a finger thereof resists passively to the golf club movements throughout the backswing. Both the arms are rotatable around an axis set perpendicularly to a swing plane of the club head, at a user's hips height in a housing, so that both guiding- and resistance-arms do not interferer with user's arms and body movements during exercising the swing by the user with the device.

From the end of the backswing during a forward swing the resistance-arm is working as an interactive guiding component for interactive guiding a golf club, when a resistance-arm finger pushing interactively against a golf club shaft at a point near to a club grip, and the guiding-arm, in its turn, resisting passively to the golf club movements by the lead, which will be released from the guiding-arm at a defined point of the swing, while the resistance-arm finger continuing to push on the club shaft through a hitting portion of the swing; thereby enabling the user to accelerate the swing motion and hit a ball without any hindrance from the guiding components by naturally swinging follow-though.

Thus, the nature of guiding forces, i.e. towing and resistive forces through the backswing, and pushing and resistive forces through a forward swing, simultaneously applied to the golf club at two apart points thereof via the finger and the guiding lead, provide guiding, and enhance positional control of the club shaft at each interactive moment of the swing motion. A driving unit and a computer system provide controlled rotation of both the guiding- and resistance-arms throughout the training swing by the user. The device is equally applicable to a baseball bat.

Devices have been provided in the past for improving a practice swing of a golf club, baseball bat, or the like, and generally these have been restricted to practice and develop a correct repeating swing from the waiting stance to follow-through under conditions in close proximity to the real ones.

SUMMARY OF THE INVENTION

According to the present invention there is provided the guiding device for teaching a user to master a golf swing, comprising the guiding components for interactive and passive guiding the golf club throughout the training swing by the user from the waiting or golfer's stance up to the end of the backswing, and through the forward swing up to the ball impact zone, and that allows the user to hit a ball without any hindrance from the guiding components by naturally swinging follow-though.

The guiding components are a rotatable guiding-arm, a short guiding lead thereof moveably connected to the distal end of the golf club through a ring tows interactively the club shaft up to the end of the backswing, and a rotatable resistance-arm, a finger thereof resists passively to the golf club movements throughout the backswing. Both the arms rotate around an axis set perpendicularly to a swing plane of the club head in the housing positioned below the swing plane and on a user's side, approx. at the user's hips height, so that the guiding- and resistance-arms do not interferer with user's arms and body movements during exercising the swing by the user with the device. Both the guiding- and resistance-arms are curved three-dimensionally in order to provide the form thereof to not interfere with the user's hips and thighs in the waiting or golfer's stance, and the user's arms and body parts at the end of the backswing, and through the forward swing.

The housing positioned on a user's side and below the swing plane of the club head comprises a base house and an upper house; the base house is adapted to be anchored to a surface, so that to not interfere with a user's foot, when exercising by the user. The upper house extending upwards from the base house has a front-upper, angled structure, at approx. user's hips height, situated parallel to the swing plane of the club head, on which an axle for both the arms is fixed. The upper house is formed to not interfere with the user's thigh and hips, when exercising by the user.

A driving unit and a computer system provide controlled rotation of both the guiding- and resistance-arms throughout the training swing by the user. The resistance-arm finger situated perpendicularly to the swing plane of the club head strokes the club shaft at a point between the club grip, i.e. the user's hands, and the guiding-arm lead, which is connected to the distal end of the golf club by means of the ring, which slides along the club shaft during the training swing; wherein a length of the resistance-arm finger provides secure contact thereof with the golf shaft throughout the swing.

This advantageous fashion of applying the guiding forces to the golf club in the present disclosure allows reciprocating movements of the golf club relative to the resistance-arm finger and the distal end of the guiding-arm throughout the swing, thereby allowing guiding the golf club along an ellipsoid-trajectory, which is the natural form of the golf swing, as well as, guiding the club grip in other swing plane than the club head swing plane by means of the guiding- and resistance-arms, which are rotated around the stationary axis.

The natures of guiding forces, i.e. towing and resistive forces through the backswing, and pushing and resistive forces through the forward swing, simultaneously exerted on the golf club at two apart points thereof via the finger and the lead, provide guiding, and enhances positional control of the golf club at each interactive moment of the swing motion. It will be understood that by varying interactively the speed of rotation of each arm by means of a computer-controlled electric motor will be provided desired guiding and positioning the golf club along the golf swing ellipsoid-trajectory at each interactive moment of the swing.

This means that through the backswing the pace or rhythm thereof will be defined by the speed of rotation of the guiding-arm, when the guiding lead tows interactively the distal end of the golf club, as the speed of rotation of the resistance-arm will define positioning the golf shaft, when the resistance-arm finger resists passively to golf club movements. On the contrary, during the forward swing the pace or rhythm thereof will be defined by the speed of rotation of the resistance-arm, when the finger thereof pushes interactively against a golf club shaft at a point near to a club grip, as the guiding-arm, in its turn, passively resists to the golf club movements by the guiding lead at a point near to the club head.

It will be also understood that throughout the training swing the resistance-arm finger working as a pivot point for the golf shaft by interactive varying the speed of rotation of each arm by the computer system, thereby providing controlled positioning the club shaft relative to the user's forearms. Thus, it will be interactively controlled an angle between the club shaft and the user's forearms, i.e. wrists positions relative to the user's forearms, correspondingly wrists actions throughout the training swing by the user.

The guiding-arm lead, and correspondingly the club, will be released from the guiding-arm at the defined point of the forward swing controlled by the computer system by means of an trigger mechanism, which is adjustably mounted on the distal end of the guiding-arm and connected with guiding-arm lead through another ring thereof, while the resistance-arm finger continue to push on the club shaft, thereby enabling the user to accelerate the swing motion and hit the ball without any hindrance from the guiding components by naturally swinging follow-though.

The driving unit mounted in the upper house comprises a support for carrying two electric motors, a driving shaft, a hollow spindle, and two gearwheels, and provides rotation of both the arms. Both the electric motors are controlled by the computer system, which controls interactively the speed of rotation of each arm, the point of the end of the backswing, and the point of the forward swing at which the golf club will be set free from the guiding-arm.

The present invention relates to a "guidance system" that interactively and passively guides a user throughout a golf training swing. The term "guidance system" refers to any type of visual or kinesthetic training aid that literally guides a player's behavior. The word kinesthetic in relation to sports training indicates something, which is felt or perceived physically while it is experienced. This means that if users can experience physically what its like to swing the golf club through the assistance of a golf swing guiding device, they will then be able to repeat that feeling under real conditions.

The term "interactive guiding" refers to a guiding component, which defines interactively the pace of the movement, as a "passive guiding" component defines positioning of the golf club shaft, correspondingly the user's wrists positions, relative to the user's forearms along the golf swing trajectory at each interactive moment of the training swing. Thus, it can be seen from the foregoing description that training device of the present invention allows a user to practice and develop a correct repeating swing from the waiting stance to follow-through under conditions in close proximity to the real ones.

The exercise is best done at slow speed (no less than 3 seconds to complete the swing) so a user can focus on what is happening throughout the motion. The motto or concept of the present golf swing training device is outlined as follows:

By practice with the help of a training device slow exercising;
by the slow exercising passive and interactive guiding;
by the guiding seeing;
by the seeing getting feeling;
by the getting feeling learning;
by the learning automating.

All of the designed features noted above work together to provide the guiding device for training a golf swing, which allows the user to train the golf swing with his own golf club under conditions in close proximity to the real ones.

DETAILED DESCRIPTION OF THE INVENTION

In embodiments of the present invention, a device is a golf swing training device, such as a training device 30, are illustrated in FIGS. 1-13. FIGS. 1, 2, 4 and 5, which illustrate the use of an embodiment of the invention with the user's positions in the waiting or golfer's stance 10 of FIGS. 1 and 2, and at the end of the backswing 10*bsw* of FIG. 4, and at a point of the forward swing 10*fsw* of FIG. 5 at which a golf club 20*fsw* will be set free from a guiding-arm 50*fsw*.

Figure 1:
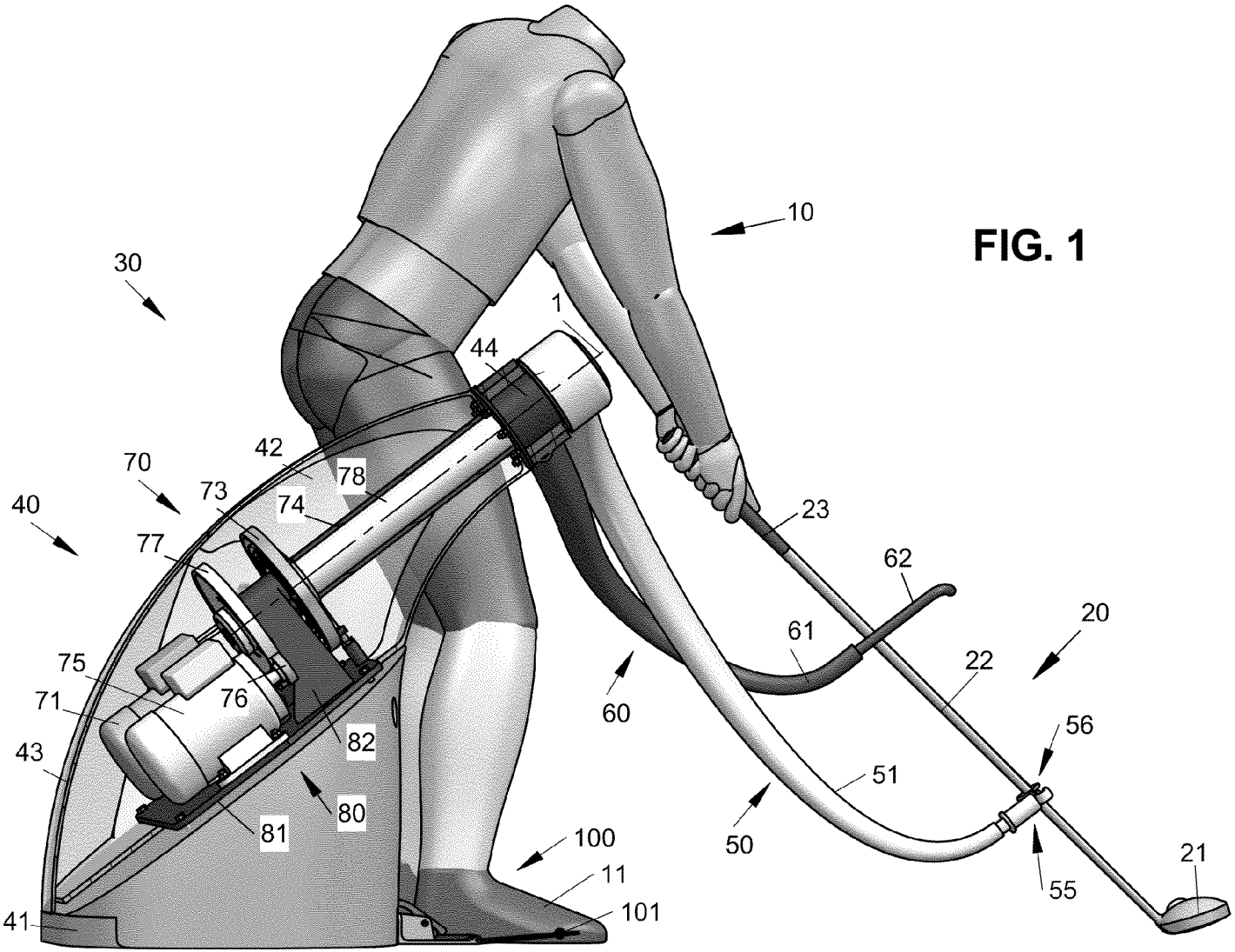
FIG. 1 shows a perspective, shaded view, partially in section, of a training device of the present invention with a user in a golfer's stance.
Figure 2:
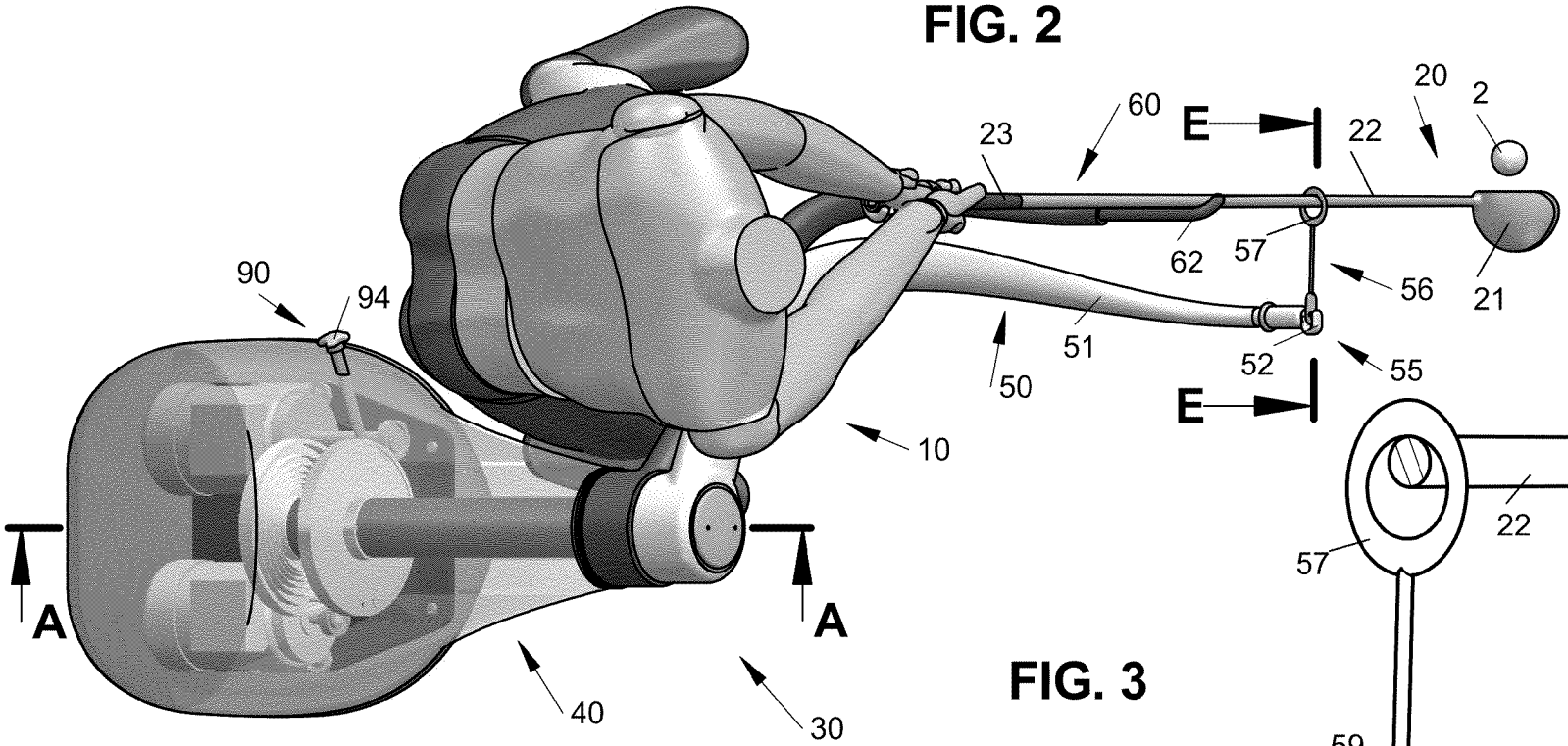
FIG. 2 shows a top, shaded view, partly in phantom form and partly in diagrammatic form, of a device of the present invention with a user in a golfer's stance.

FIGS. 1 and 2 show the training device 30 with the user 10 in the waiting or golfer's stance. As illustrated in FIG. 1 a housing 40 positioned at the user's side and below a swing plane (not illustrated) of a club head 21 comprises a base house 41, an upper house 42, and maintenance cover 43. The base house 41 is adapted to be anchored to a base (not illustrated) on a ground and placed so that to not interfere with a user's foot 11; the upper house 42, in its turn, is formed to not interfere with a user's hips, when exercising the swing by the user. The base house 41 and upper house 42 are bolted together on a common plane arranged parallel to an axis 1 of a hollow axle 44 which is situated perpendicularly to the swing plane of the club head 21. The hollow axle 44 carrying both a rotatable resistance-arm 60 and guiding-arm 50 is fixed through a flange on a front-upper, angled, outer structure of the upper house 42.

The guiding-arm 50 has an axial end and a distal end which is oriented perpendicularly to the swing plane of the club head. On the distal end of the guiding-arm 51 is adjustably mounted a trigger mechanism 55 which is connected through a guiding-arm lead 56 to a distal end of a club shaft 22. The guiding-arm lead 56 comprises a first ring 58, a second ring 57, and a connecting rod 59 which connects both the rings. As one end of the guiding-arm lead 56 is connected by the first ring 58 to the trigger mechanism 55, a second end thereof is connected by the second ring 57 (see FIGS. 2 and 3) to the club shaft 22, in a fashion such that the second ring 57 slides along it, when exercising the swing by the user. The guiding-arm lead 56 can be fabricated from nylon material as of one piece. The inner size of the second ring 57 is defined by a diameter of the golf grip so that it can go through it to be put on the shaft 22.

The resistance-arm 60 has an axial end and a distal end. A resistance-arm finger 62 is arranged on the distal end of a resistance-arm 61 and situated perpendicularly to the swing plane of the club head 21, so that the resistance-arm finger 62 strokes the club shaft 22 at a point between a club grip 23, i.e. the user's hands, and the second ring 57 of the guiding-arm lead 56, when exercising the swing by the user. A length of the resistance-arm finger 62 is chosen so to provide secure contact for the resistance-arm finger with the club shaft 22 at the waiting stance, and at the end of the backswing, and through the forward swing, thereby allowing guiding the club grip in other swing plane than the club head swing plane as the user is swinging the golf club.

This fashion of applying the guiding forces to the golf club allows reciprocating movements of the golf club 20 relative to the resistance-arm finger 62 and the distal end of the guiding-arm 50 throughout the swing, thereby allowing guiding the golf club along an ellipsoid-trajectory (not illustrated), which is the natural form of the golf swing, as well as, guiding the club grip 23 in other swing plane than the club head swing plane by means of the guiding-arm 50 and resistance-arm 60 having the stationary rotation axis 1 of the axle 44.

A driving unit 70 and a computer system provide controlled rotation of the guiding-arm 50 and resistance-arm 60 throughout the training swing by the user. It will be appreciated by those skilled in the art that various computer system alternatives for providing controlled rotation of the both arms are well known and available, such as a Motion Analyses Technology by TaylorMade (MAT-T) system which might be substantially simplified for the use in combination with the present disclosure.

As further seen in FIG. 1, the driving unit 70 is mounted in the upper house 42 and comprises a support 80, two electric motors 71 and 75, two gearwheels 73 and 77, a hollow driving spindle 74, and a driving shaft 78 extending longitudinally through the hollow driving spindle 74. The support 80 includes a plate 81 above which is elevated a bearing support 82 for carrying the gearwheels 73 and 77, the driving spindle 74, and driving shaft 78. The bearing support 82 extends along the rotation axis 1, and is supported above the plate by two tilted walls and a cross wall, which are integral with the plate 81. The support 80 is bolted together with the structures of the upper house 42 and base house 41 through the plate 81.

An electric motor 71 is mounted on the plate 81 and engaged through a motor spur gear 72 (see FIGS. 9 and 11) with a resistance-arm gearwheel 73, which is fixed on one end of the hollow driving spindle 74 and on an opposite end thereof the resistance-arm 60 is fixed. On the transversely side of the bearing support 82 is mounted parallel a second electric motor 75, which is engaged through a motor spur gear 76 with a guiding-arm gearwheel 77, which is fixed on one end of the driving shaft 78 and on an opposite end thereof the guiding-arm 50 is fixed (see FIGS. 6 and 10).

Figure 3:
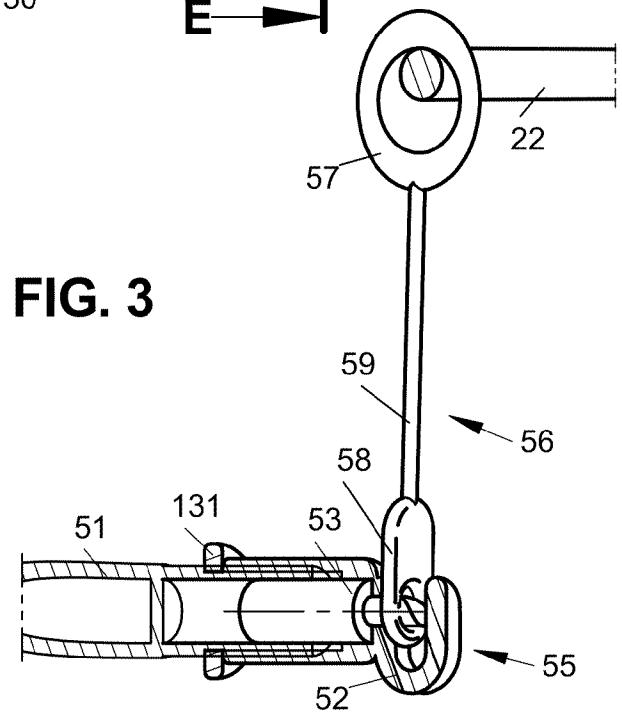
FIG. 3 shows an enlarged fragmentary cross-sectional view in diagrammatic form of FIG. 2 taken along the line E-E.

As best seen in FIG. 2, a top view of the device 30 with the user 10 in the waiting stance, the user's hips do not interfere with the upper house 42, when exercising the swing by the user. FIG. 3, an enlarged cross-sectional view of the distal end of the guiding-arm 50 and golf club 20, shows the trigger mechanism 55, which is adjustably mounted on the distal end of the guiding-arm 51. The trigger mechanism 55 comprises a fork like trigger-head 52, which is adjustably screwed on the distal end of the guiding-arm 51, a lifting magnet mechanism 53 being built in the fork like trigger-head and adapted to the hollow spacing of the distal end of the guiding-arm 51, and a lock-nut 131 for locking the position of the fork like trigger-head on the distal end of the guiding-arm.

It will be appreciated by those skilled in the art that various lifting magnet mechanisms are well known and available; wherein a moveable core thereof is regularly kept in the closed position by a spring (not illustrated) and will be moved in the open position by an electromagnet (not illustrated) at a point of the forward swing controlled by the computer system. Through this interaction at the defined point of the forward swing the ring 58 of the guiding-arm lead 56 will be set free from the trigger mechanism 55, and correspondingly from the guiding-arm 50.

It will be understood that the height of the swing plane of the club head relative to the upper house will be changed, when adjusting the position of the trigger head along the distal end of the guiding-arm by the user. This means that the trigger mechanism being adjustably mounted on the distal end of the guiding-arm allows the user to adapt the use of the training device 30 for the body height of the user.

Figure 4:
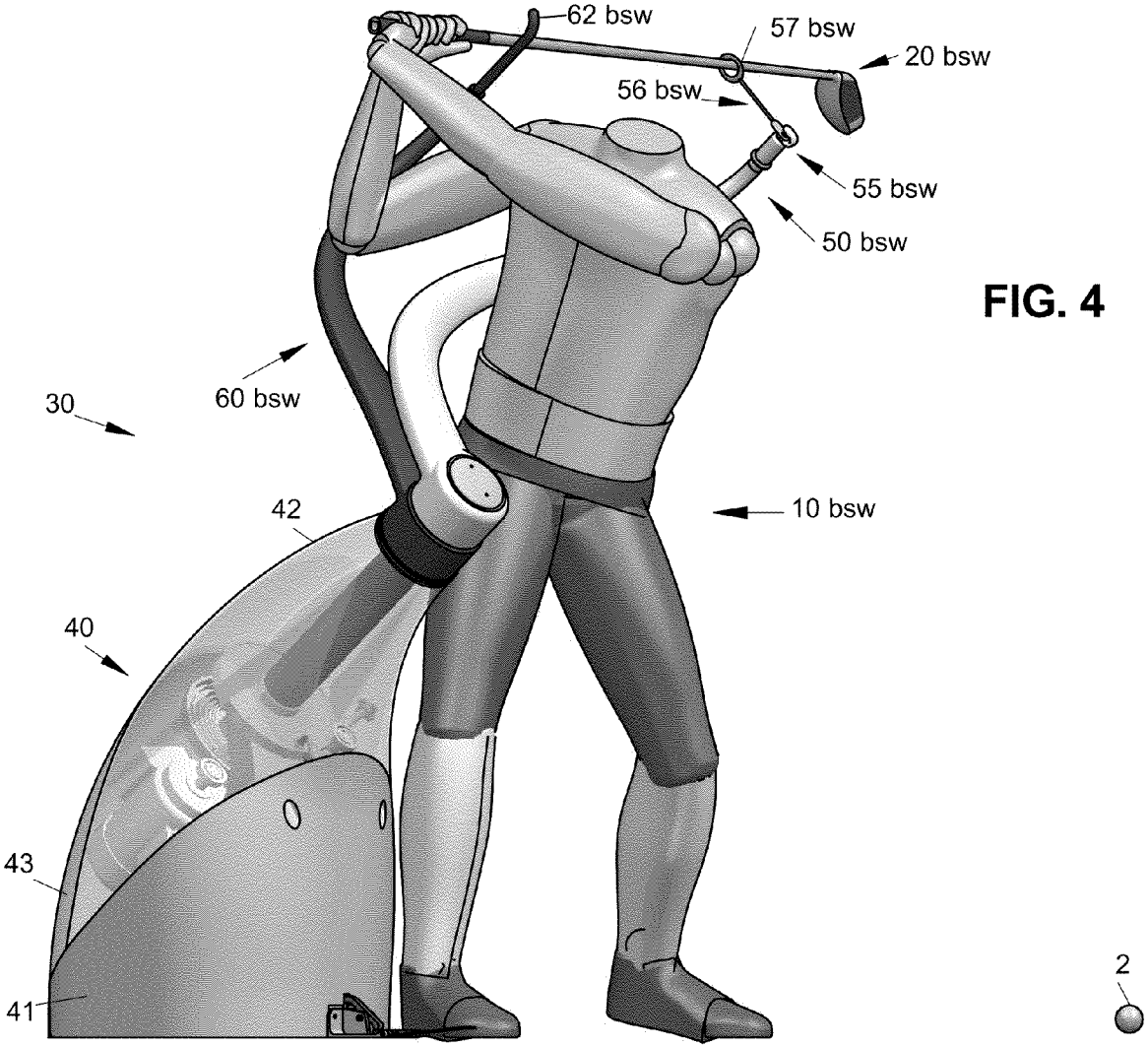
FIG. 4 shows a perspective, shaded view, partly in phantom form and partly in diagrammatic form, of a device of the present invention with a user in position at an end of the backswing.

FIG. 4 illustrates the training device 30 with the user's position 10 bsw at the end of the backswing. As seen on FIGS. 1, 2, and 4, the guiding-arm 50 and resistance-arm 60 are curved three-dimensionally in order to provide the form of each to not interfere with the user's hips and thighs at the waiting stance, and the user's arms and body parts at the end of the backswing (see positions 50*bsw* and 60*bsw*). Both the arms have the monocoque construction fabricated from the composite carbon material, which allows minimizing the weight and, at the same time, providing necessary rigidness and stability thereof. Through the backswing the pace or rhythm thereof will be defined by the speed of rotation of the guiding-arm 50, when the guiding-arm lead 55 towing interactively the distal end of the golf club 20, as the speed of rotation of the resistance-arm 60 will define positioning the club shaft 22 relative to the user's forearms, when the resistance-arm finger 62 resisting passively to golf club movements.

It will be understood that by varying interactively the speed of rotation of each arm by means of a computer-controlled electric motor will be provided desired guiding and positioning the golf club along the golf swing ellipsoid-trajectory at each interactive moment of the swing. At the end of the backswing the movement of the resistance-arm 60 will be stopped by the computer system or mechanically wherein the point 60*bsw* is adjustable by a one-way stop device 90 of FIGS. 2, and 11, as it will be described further. Thus, at the end of the backswing position 60*bsw* of the resistance-arm will define the height of the positioning 20*bsw* of the golf club while the position 50*bsw* of the guiding-arm will define the positioning 22*bsw* of the club shaft, and correspondingly the user's wrists positions, relative to the user's forearms.

Figure 5:
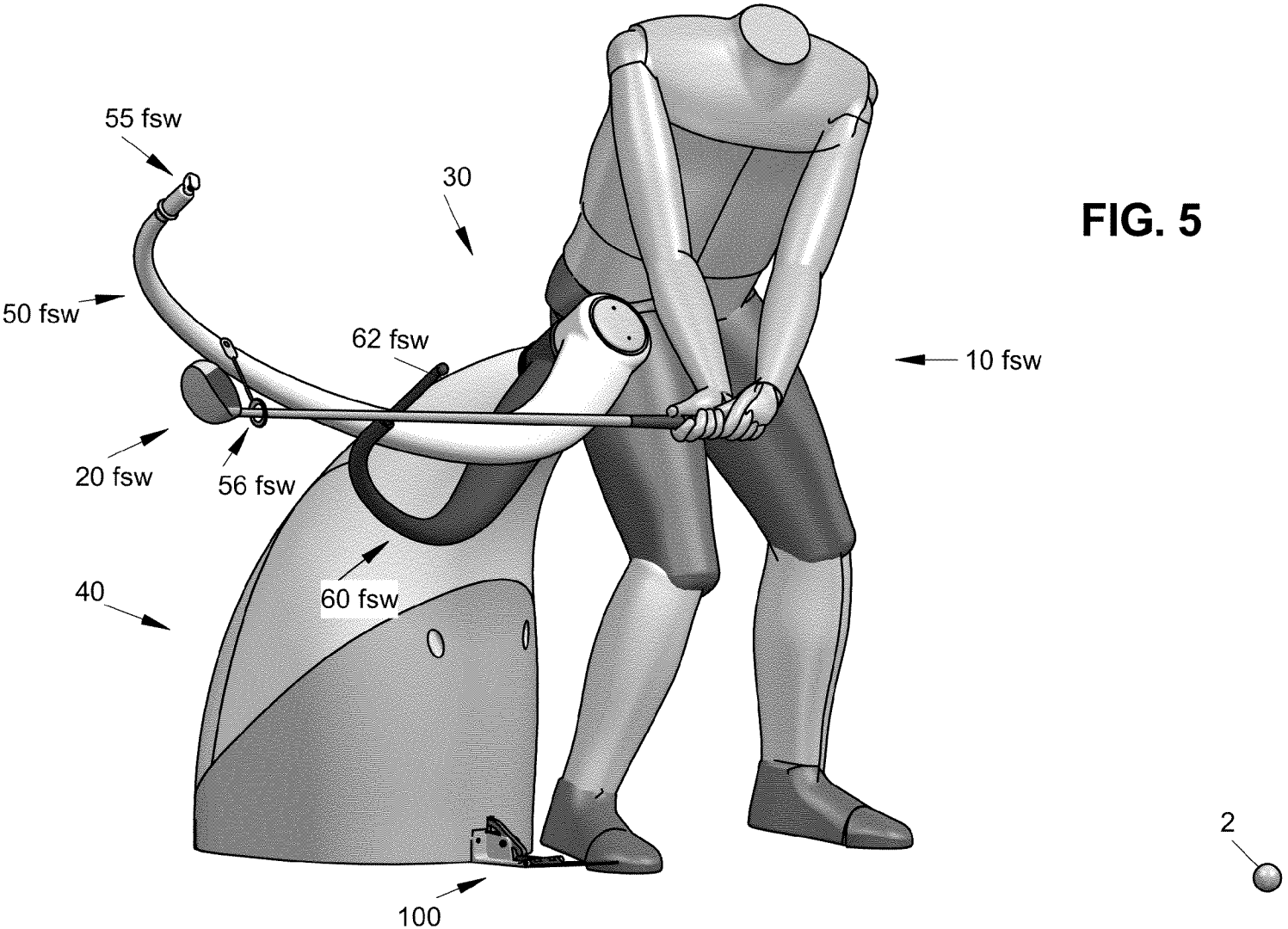
FIG. 5 shows a perspective, shaded view of a device of the present invention with a player in position at a point of a forward swing at which a golf club will be set free from a guiding-arm.

FIG. 5 illustrates the training device 30 with the user's position 10*fsw* at the point of the forward swing at which the guiding-arm lead 56*fsw*, and correspondingly golf club 20*fsw*, will be set free from guiding arm 50*fsw* while resistance-arm finger 62*fsw* continue to push on club shaft 22*fsw*, thereby enabling the user to accelerate the swing motion and hit a ball 2 without any hindrance from the guiding components by naturally swinging follow-through. After this interaction the movements of the guiding-arm 50 will be slowed down by the computer system, and finally, stopped in the waiting stance position. As well as, shortly, after releasing the golf club 20 from the guiding-arm 50, the movements of the resistance-arm 60 will be slowed down by electro motor controlled by the computer system, and finally, the resistance-arm will be stopped by a one-way stop device 120 mounted on the plate 81 of the driving unit support 80 (see FIGS. 9 and 11) in the waiting stance position, as it will be described further.

As described above, the guiding-arm lead 56*fsw* after setting free from the guiding arm 50*fsw* by means of the trigger mechanism 55 stays hanging on the club shaft throughout hitting the ball 2 and swinging follow-through by the user. It is believed that the minimized size, and correspondingly the weight, of the guiding-arm lead 56 will not considerably influence on user's motions, when hitting the ball and follow-through by the user.

To prepare the device for the next use the user must take the waiting stance as illustrated in FIGS. 1, and 2 and put with the hand the ring 58 of the guiding-lead 56 into the fork of the trigger-head 52; a moveable core of the lifting magnet mechanism 53 having an angled surface will be pressed down and popped up into the ring 58 by the spring (not illustrated), thereby fasten the guiding-arm lead 56 to the trigger mechanism 55. Thus, as it can be seen from the foregoing description, the training device 30 of the present invention allows the user to practice and develop the correct repeating whole swing from the waiting stance up to follow-through under conditions in close proximity to the real ones.

Figure 6:
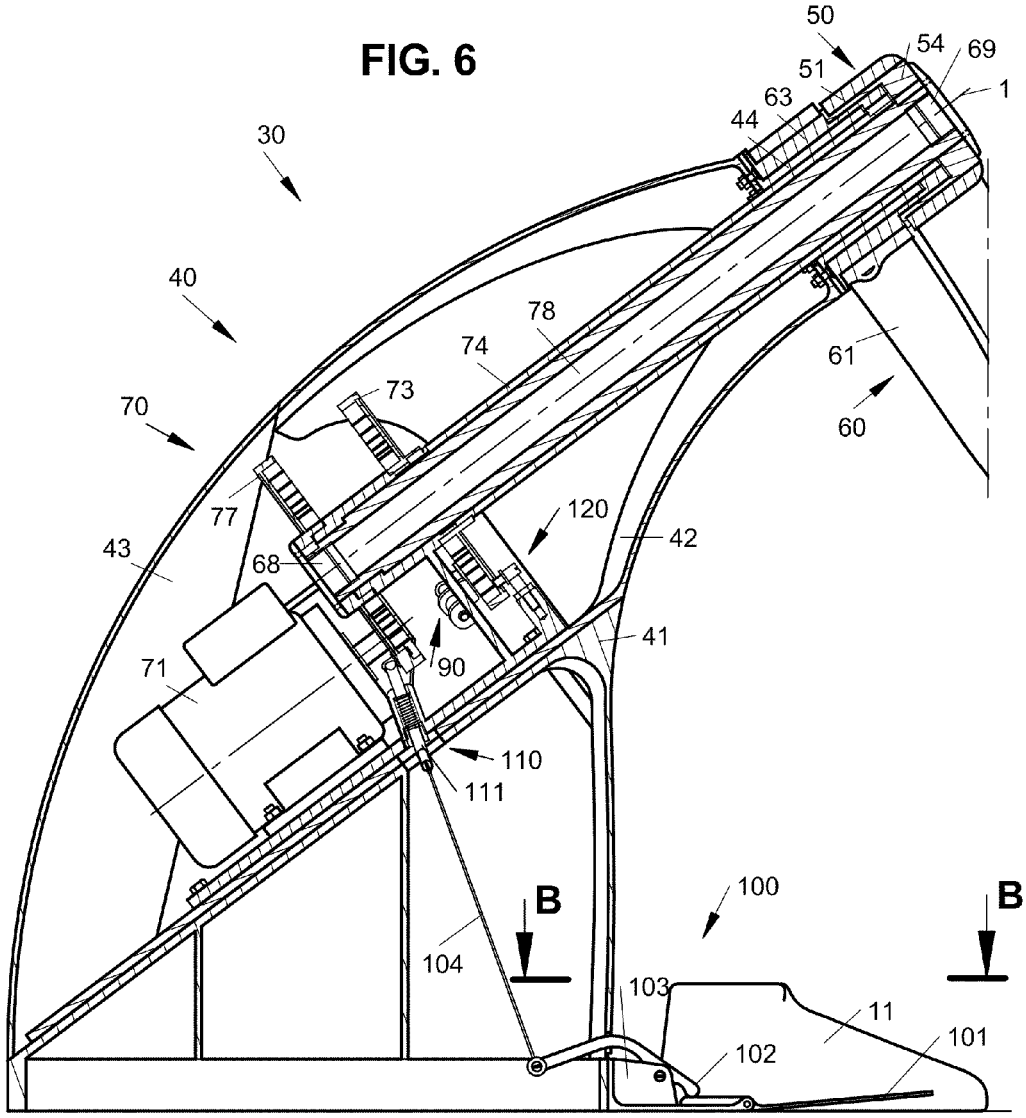
FIG. 6 shows an enlarged fragmentary cross-sectional view in diagrammatic form of FIG. 2 taken along the line A-A; a user is not illustrated, but a user's right foot.

As best seen in FIG. 6, both the base house 41 and upper house 42 have the monocoque construction fabricated from composite materials such as fiberglass, carbon and so on, which can provide necessary rigidness and stability of the housing 40. The base house 41 is bolted to a ground base (not illustrated) along a perimeter of a strengthened base edge of the house 41 arranged vertically to the ground. The base house 41 and upper house 42 are bolted together on a common plane arranged parallel to axis 1 of the hollow axle 44 which is situated perpendicularly to the swing plane of the club head.

Figure 7:
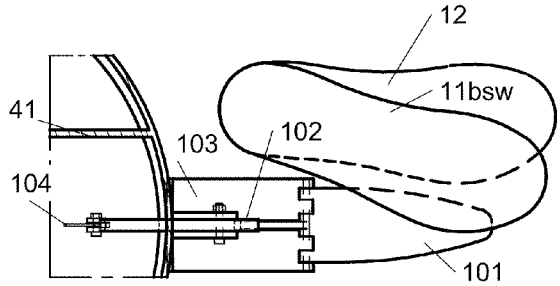
FIG. 7 shows a cross-sectional view in diagrammatic form of FIG. 6 taken along the line B-B; a user is not illustrated, but a user's right foot.

As further seen in FIGS. 6 and 7, in front-outside of the house 41, on the base edge thereof is mounted a lockout mechanism 100 for activating movements of the guiding-arm 50 at the waiting stance by the user. The lockout mechanism 100 includes a rotatable treadle 101 hinged on a bracket 103 on an axle thereof placed closely to the ground, a swinging member 102 hinged on the bracket 103 over the treadle 101 and a control rod 104 which is hinged on a second end of the swinging member. The bracket 103 is mounted on the outside, base edge of the base house 41. The rotatable treadle 101 has on one end a forward elongated pedal, which is biased slightly upwards, and on an opposite end a short tail, which is situated parallel to the ground so that to contact with a first end of the swinging member 102. On the second end of the swinging member 102, which extends through an aperture of the house 41 into interior space thereof, is hinged a control rod 104, which is coupled with a first end of a moveable catch 111 of an one-way stop mechanism 110, which limits movement of the gearwheel 77, and correspondingly the guiding-arm 50, in the backswing direction at the waiting stance, as it will be described further.

In the waiting stance, the user's foot 11 of FIG. 6, when placed on a foot pint 12 of FIG. 7, which defines the position of the user's foot relative to the base house, is oriented parallel to the pedal of the treadle 101. To activate the movement of the guiding-arm 50 the user must raise slightly their toe, turn the foot 11 around its heel in the position 11*bsw* of FIG. 7, and then tread with the foot on the pedal in order to turn the treadle. By turning the treadle 101 the short tail thereof will turn a swinging member 102 thereby moving the control rod 104 and correspondingly setting in the motion a moveable catch 111, which limits the movement of the guiding-arm gearwheel 77 by a stop pin 114 fixed on the gearwheel 77 (see FIGS. 9 and 10).

Figure 9:
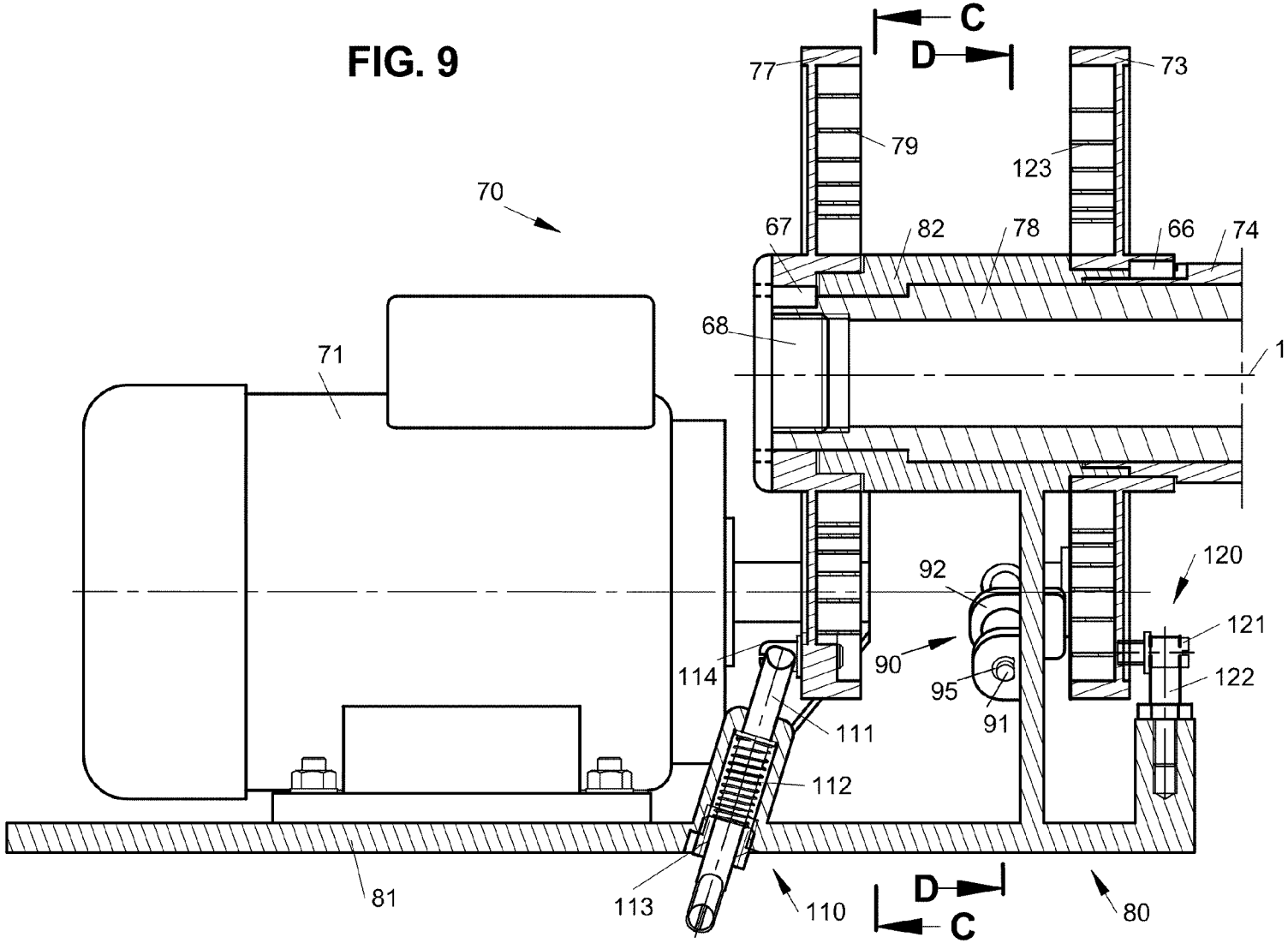
FIG. 9 shows an enlarged fragmentary cross-sectional view of a guiding unit illustrated in FIG. 6.

As better seen on FIG. 9, the one-way stop mechanism 110 is built on the plate 81 of the support 80. A compression spring 112 is placed between a spring stop 113 screwed into the plate 81 and a stop lug of the moveable catch 111, thereby providing keeping the moveable catch 111 in the locking position and at the same time allowing passing the stop pin 114 through by turning the gearwheel 77 in the forward swing direction, when the stop pin 114 contacts with an angled surface of a second end of the moveable catch 111. Thus, by treading with the foot on the pedal of the treadle 101 by the user, the gearwheel 77, and correspondingly the guiding-arm 50, will be released for turning by the electric motor 71 and a pre-strained coil spring 79 of FIG. 10 in the backswing direction. Rather than switches being mechanically actuated, photoelectric or optical devices could be used to sense the short foot step of the user.

As further seen on FIG. 9, a first end of the bearing support 82, which has the common rotation axis 1 with the hollow axle 44, has an outer cylindrical surface fitted for carrying the resistance-arm gearwheel 73 and a second end thereof has the similar one fitted for carrying the guiding-arm gearwheel 77. The guiding-arm driving shaft 78 extends longitudinally through the bearing support 82 and further through the hollow driving spindle 74. A first end of the guiding-arm driving shaft 78 is journalled for rotation in the second end of the bearing support 82. Note that, the guiding-arm driving shaft 78 has a radial thrusting surface, which provides supporting the driving shaft 78 by a corresponding, radial thrusting surface of the bearing support 82 in the axial direction. A gearwheel stop 68 fixed by the screw-thread on the first butt-end of the driving shaft 78 limits movement of the gearwheel 77 in the axial direction as a bushing key 67 engages the gearwheel 77 with the driving shaft 78 in the radial direction.

A first end of the hollow driving spindle 74 is journalled for rotation in the first end of the bearing support 82. Note that, the hollow driving spindle 74 has a radial thrusting surface, which provides supporting the hollow driving spindle 74 by corresponding radial thrusting surface on the first butt-end of the bearing support 82 in the axial direction. The bushing key 66 engages the gearwheel 73 with the hollow driving spindle 74 in the radial direction. A one-way stop device 120 of FIGS. 6 and 9, which limits movement of the gearwheel 73 in the forward swing direction, comprises a stop pin 121 mounted on the gearwheel 73 and a stop pin 122 fixed in a cylinder, which is integral with the plate 81 and protruding above it.

Figure 8:
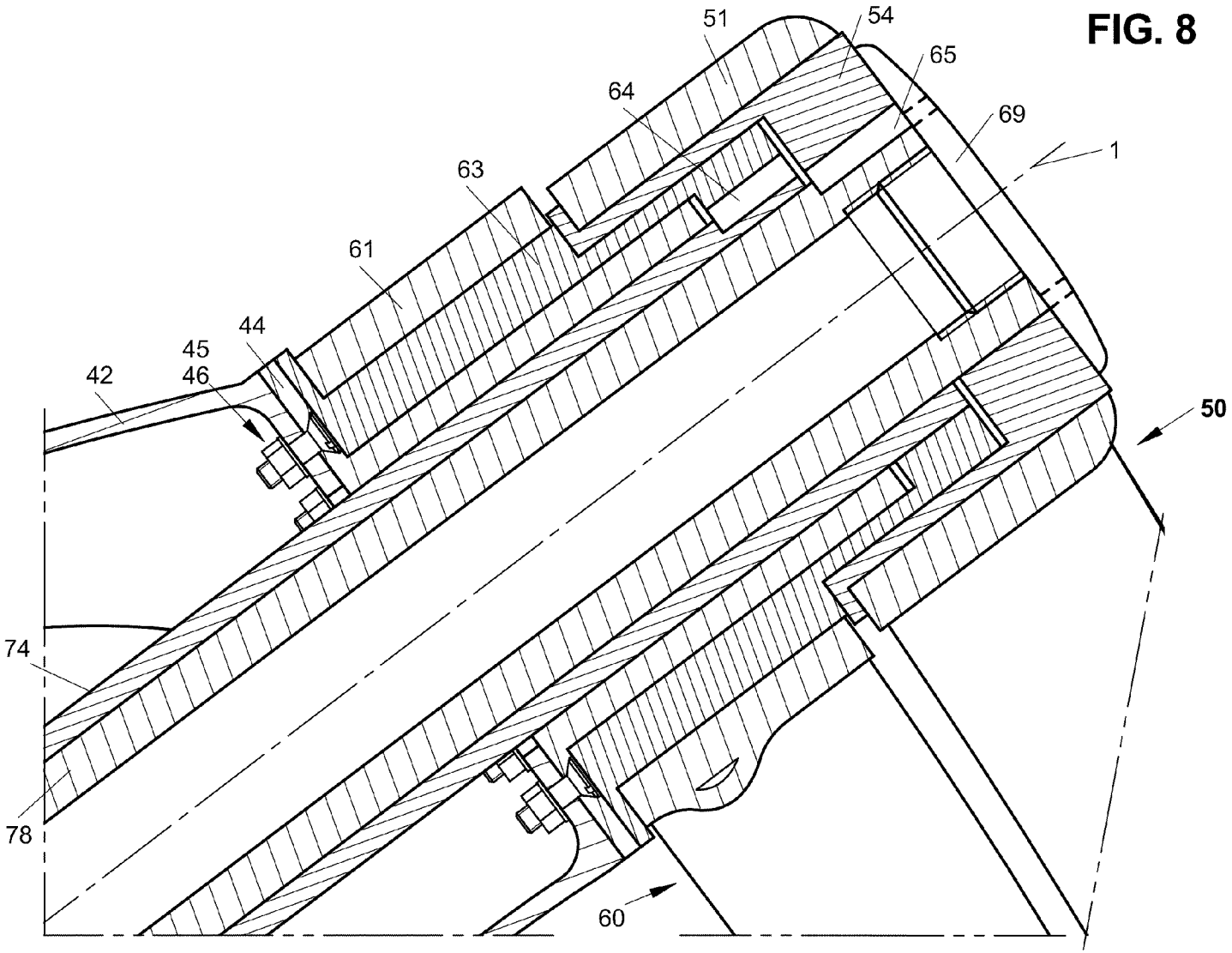
FIG. 8 shows an enlarged fragmentary view of FIG. 6.

FIG. 8 shows an enlarged fragmentary view of FIG. 6. As seen on FIG. 8, the hollow axle 44 is mounted through a flange on the front-upper, angled, outer structure of the upper house 42 by means of the set of flange bolts 45 and nuts 46. An outer cylinder of the hollow axle 44 extending upwards from the flange is fitted for carrying a resistance-arm bearing bushing 63, which is glued into the axial end of the resistance-arm 61. A flange of the bearing bushing 63 is seated on the flange of the hollow axle 44 which provides supporting the resistance-arm 60 in the axial direction. The bearing bushing 63 protrudes upwards out of the axial end of the resistance-arm 61 and hollow axle 44, thereby providing an outer cylindrical surface for carrying the guiding-arm 50.

A second end of the hollow driving spindle 74 extends longitudinally throughout the hollow axle 44 up to a butt-end of the bearing bushing 63. A part of the driving spindle 74 extending from the hollow axle 44 up to the butt-end of the bearing bushing 63 serves for seating a bushing key 64, which engages the hollow driving spindle 74 with the bearing bushing 63, correspondingly with the resistance-arm 60, the end thereof has an inner cylindrical surface fitted to an outer cylinder of the hollow driving spindle 74. An inner cylindrical surface of the bearing bushing 63 fitted to the outer cylinder of the hollow axle 44 is journalled for rotation on the outer cylinder of the hollow axle 44 only.

The bearing bushing 63 protruding out of the axial end of the resistance-arm 61 has a radial thrusting surface, which supports a guiding-arm bearing bushing 54, which is glued into an axial end of the guiding-arm 51, in the axial direction. The guiding-arm bearing bushing 54 is journalled for rotation on the outer cylinder of the bearing bushing 63 only. The guiding-arm driving shaft 78 extends through the hollow driving spindle 74, wherein a second end thereof is engaged by the bushing key 65 with the bearing bushing 54, correspondingly with the guiding-arm 50, having a second inner cylindrical surface fitted to the cylinder of the driving shaft 78. A guiding-arm stop 69 fixed by screw-thread on a second butt-end of the driving shaft 78 limits movements of the guiding-arm 50 in the axial direction.

Figure 10:
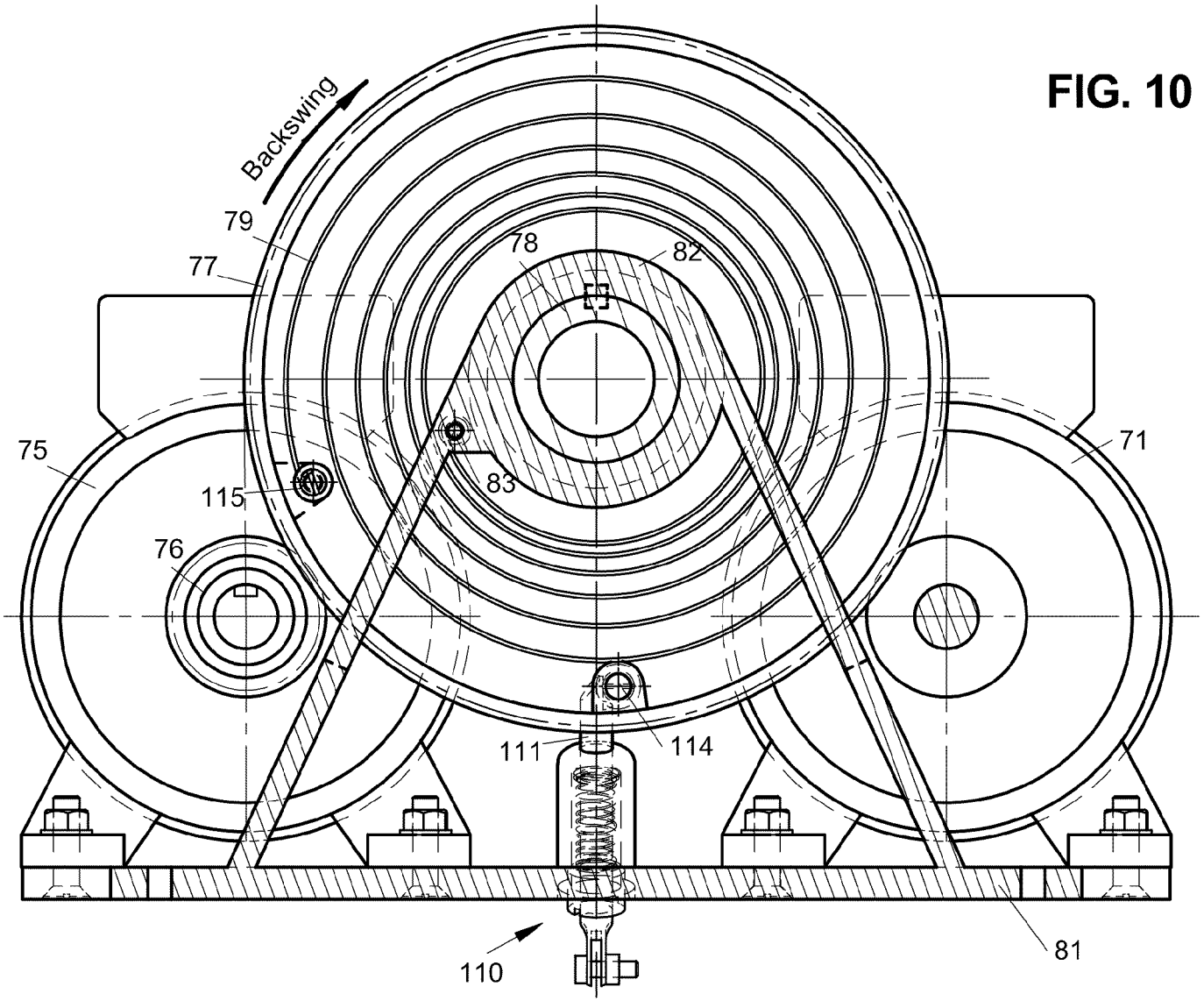
FIG. 10 shows a cross-sectional view of FIG. 9 taken along the line C-C.

As seen on FIGS. 1, and 10, and mentioned above, rotation of the gearwheel 77 is provided by the second computer-controlled electric motor 75, which is engaged through the motor spur gear 76 with the guiding-arm gearwheel 77. It will be appreciated by those skilled in the art that a multiple reduction gear could be used, if necessary, to provide transmission of rotation from the electric motor to the guiding component. As illustrated in FIG. 10, a pre-strained coil spring 79 is mounted and oriented on the guiding-arm gearwheel 77, so that to turn the guiding-arm 50 in the backswing direction, thereby facilitating interactive guiding of the guiding-arm 50 throughout the backswing, and passive guiding thereof throughout the forward swing; wherein an inner end of the pre-strained coil spring 79 is attached to the bearing support 82 by means of a bolt 83 and an outer end thereof is secured to the gearwheel 77 by a bolt 115. The bearing support 82 is carried by two tilted walls over plate 81 which are integral with it.

Figure 11:
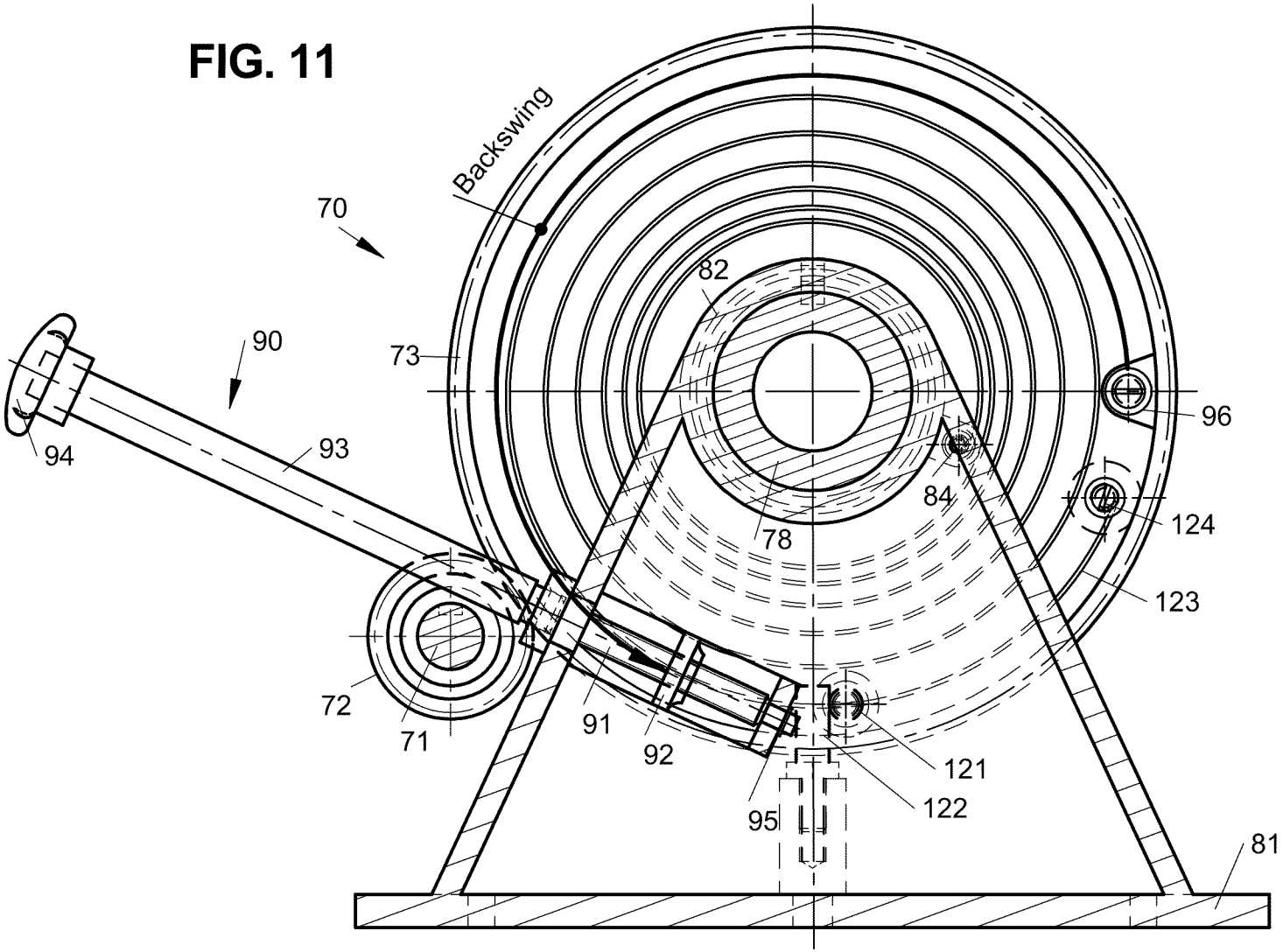
FIG. 11 shows a cross-sectional view of FIG. 9 taken along the line D-D.

FIG. 11 illustrates cross-sectional view of the guiding unit 70 of FIG. 9 with the adjustable one-way stop device 90 of FIG. 2, which allows a user to adjust the end-position of the resistance-arm 60*bsw* of FIG. 4 at the end of the backswing. By the forward swing rotation of the resistance-arm 60 will be stopped by the one-way stop device 120 of FIG. 9 at the point which corresponds with the position of the resistance-arm 60 at the waiting stance, when the stop pin 121 fixed on the gearwheel 73 meets with the stop pin 122 of FIG. 9 fixed in a cylinder protruding upwards from the plate 81. Rotation of the resistance-arm gearwheel 73 is provided by the computer-controlled electric motor 71, which is engaged through the motor spur gear 72 with the resistance-arm gearwheel 73.

As further seen on FIG. 11, a pre-strained coil spring 123 is mounted and oriented on the resistance-arm gearwheel 73, so that to turn the gearwheel 73, and correspondingly the resistance-arm 60, in the forward swing direction, thereby facilitating passive guiding of the resistance-arm 60 throughout the backswing, and interactive guiding thereof throughout the forward swing; wherein an inner end of the pre-strained coil spring 123 is attached to the bearing support 82 by means of a bolt 84 and an outer end thereof is secured to the gearwheel 73 by a bolt 124.

In order to allow the user to define a point of the end of the backswing, the adjustable one-way stop device 90 is built on the cross wall of the bearing support 82, which comprises a threaded member 91, a stop nut 92, an elongated control rod 93, a handle 94, and a stop spring washer 95. During the backswing by the user the rotation of the resistance-arm 60 will be stopped when a stop pin 96 mounted on the resistance-arm gearwheel 73 contacts the stop nut 92 screwed on the threaded member 91. A longitudinal axis of the threaded member is situated tangentially to the trajectory (indicated by an arrow line—Backswing, FIG. 11) of the stop pin 96. A head end of the threaded member 91 is rotatably mounted on the tilted wall and an opposite end thereof is journalled for rotation in a lug arranged on the cross wall of the bearing support 82.

The spring washer 95, which is fixed in a groove on an opposite end of the threaded member 91, limits movements of the threaded member in the axial direction. Through the cross wall of the bearing support 82, along the axis of the threaded member 91, between the tilted wall and the lug an aperture is cut for receiving the stop nut 92, which protrudes out of the cross wall on an opposite side, thereby providing a contact surface for the stop pin 96 (see FIG. 9). The range of the adjustment can be changed by rotating the threaded member 91 by the user, thereby changing the position of the stop nut 92 along the longitudinal axis of the threaded member 91. Rotation of the threaded member 91 by the user is provided by means of the demountable control rod 93 extending out of the upper house 42, as better seen on FIG. 2, and having on an outer end the attached handle 94. An opposite end thereof having hexahedron profile is fitted into the corresponding cut in the head of the threaded member 91.

Figure 12:
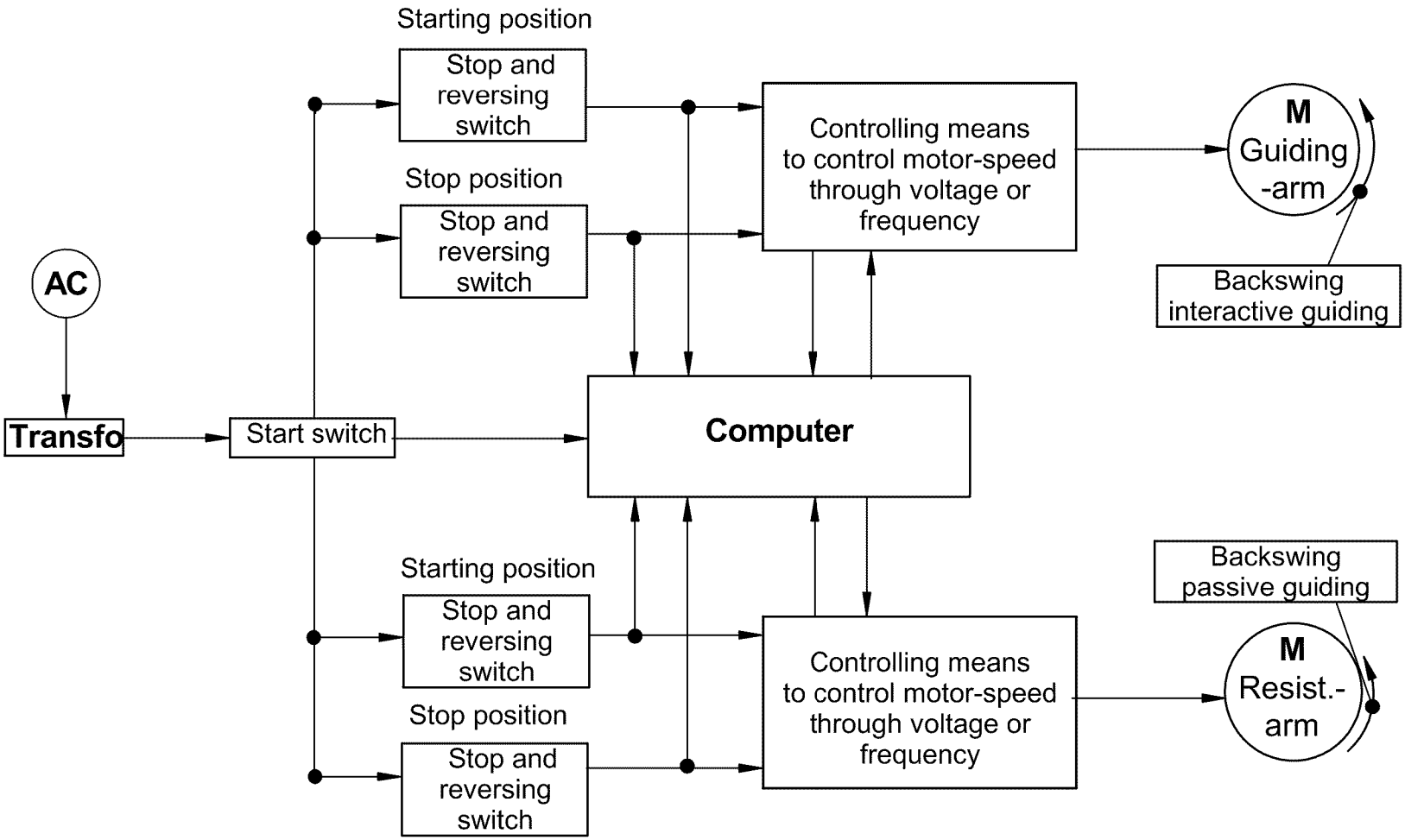
FIG. 12 is an electrical block diagram for a computer system, which illustrates operational links between power sources, a computer, switches, and electric motors, which provide functionality of the system throughout the backswing motion, when exercising by the user.

FIG. 12, an electrical block diagram for a computer system, illustrates operational links between power sources, a computer, switches, and electric motors, which provide functionality of the system throughout the backswing motion, when exercising by the user.

Figure 13:
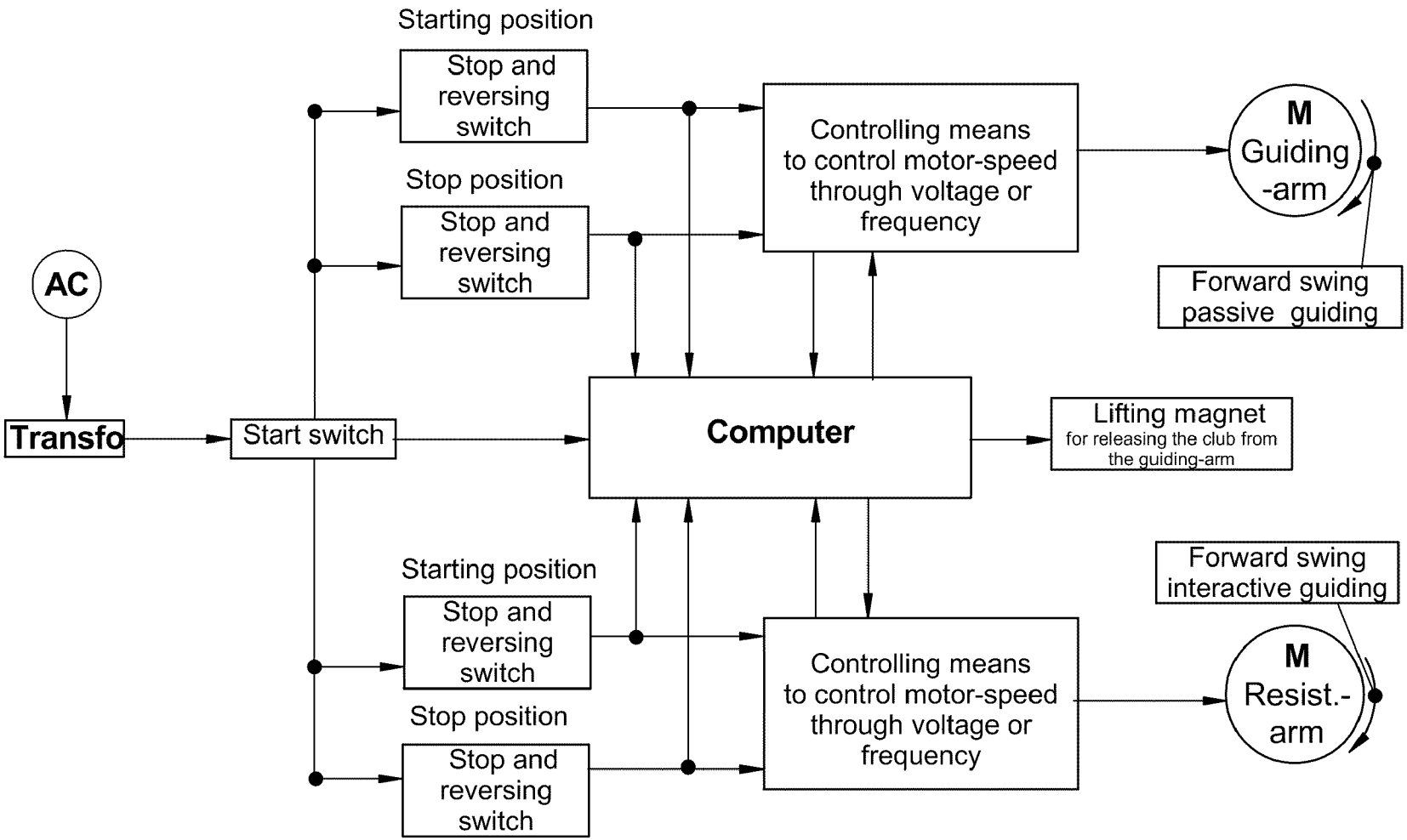
FIG. 13 is an electrical block diagram for a computer system, which illustrates operational links between power sources, a computer, switches, a lifting magnet and electric motors, which provide functionality of the system throughout the forward swing motion, when exercising by the user.

FIG. 13, an electrical block diagram for a computer system, illustrates operational links between power sources, a computer, switches, a lifting magnet and electric motors, which provide functionality of the system throughout the forward swing motion, when exercising by the user.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

I claim:

1. A training device for interactively guiding a golf club throughout a training swing by a user comprising:

a housing positioned on a ground at a user's side, and below a swing plane of a club head;

a guiding-arm for actively guiding said golf club from a golfer's stance up to an end of a backswing, said guiding-arm being rotatable around a rotation axis set perpendicularly to said swing plane of said club head at a user's hips height in said housing, so that said guiding-arm does not interfere with a user's arms and body movements during exercising the swing by a user with said device, wherein a speed of rotation of said guiding-arm defines a pace of a golf club's movements, correspondingly, a rhythm of the backswing at each point of the backswing, said guiding-arm having an axial end and a distal end which is oriented perpendicularly to said swing plane of said club head;

a guiding-arm lead having on one end a first ring being adapted for connecting to said distal end of said guiding-arm, and releasing from said guiding-arm at a defined point of the swing, and a second ring on an opposite end being moveably attached to a distal end of said golf club, wherein said second ring slides along a club shaft throughout a training swing, said guiding-arm lead having a connecting rod which connects said first ring with said second ring;

a resistance-arm for interactively guiding said golf club from the golfer's stance up to the end of the backswing, said resistance-arm being rotatable around said rotation axis set perpendicularly to said swing plane of said club head at a user's hips height in said housing, so that said resistance-arm does not interfere with the user's arms and body movements during exercising the swing by the user with said device, said resistance-arm having an axial end and a distal end, said resistance-arm having a resistance-arm finger arranged on said distal end and oriented perpendicularly to said swing plane of said club head, so that said resistance-arm finger strokes said club shaft at a point between a club grip, correspondingly, the user's hands, and said second ring of said guiding-arm lead throughout the training swing, wherein a position of said club shaft, correspondingly, a user's wrists positions relative to a user's forearms, is defined by a speed of rotation of said resistance-arm at each point of the backswing, wherein said resisting-arm finger interactively resists the moving of said club through the backswing;

a driving unit being mounted in said housing to provide rotation of both said resistance-arm and said guiding-arm throughout the training swing;

a computer system for controlling the speed of rotation of each arm at each point of the training swing;

said resistance-arm working as an interactive guiding component for actively guiding said golf club from the end of the backswing through a forward swing, when said resistance-arm finger actively pushes against said club shaft, wherein a speed of rotation of said resistance-arm controlled by said computer system defines a pace of the golf club movements, correspondingly, a rhythm of the forward swing at each point of the forward swing;

said guiding-arm working as an interactive guiding component for guiding said golf club from the end of the backswing through the forward swing, when said guiding-arm interactively resisting to the golf club movements by said guiding-arm lead, wherein a speed of rotation of said guiding-arm controlled by said computer system defines the positioning of said club shaft, correspondingly, user's wrists positions relative to the user's forearms at each point of the forward swing; and a trigger mechanism being adjustably mounted on said distal end of said guiding-arm, said trigger mechanism being connected with said guiding-arm lead by said first ring thereof, said trigger mechanism providing releasing of said guiding-arm lead, and correspondingly, said golf club from said guiding-arm at a defined point of the forward swing controlled by said computer system, while said resistance-arm finger continues pushing on said club shaft, thereby enabling the user to accelerate the swing motion and hit a ball without any hindrance from said guiding components by naturally swinging follow-through.

2. The training device of claim 1, wherein said housing comprises a base house and an upper house, said base house being adapted to be anchored to a base on the ground, said base house and said upper house being bolted together on a common plane which is positioned below said rotation axis, and situated parallel to said rotation axis.

3. The training device of claim 2, wherein at least one foot print placed on the ground defines a user's position relative to said base house.

4. The training device of claim 2, wherein said driving unit is mounted in said upper house on a structure thereof situated parallel to said common plane, on which said upper house and said base house are bolted together, said driving unit comprising:

a driving unit support including a plate, which is mounted to said structure of said upper house, and a bearing support, which extends along said rotation axis, and which is supported above said plate by two tilted walls and a cross wall, which are integral with said plate;

a first electric motor being mounted on one side of said plate to provide rotation of said resistance-arm;

a first electric motor spur gear;

a resistance-arm gearwheel being engaged with a train of said first electric motor spur gear, said resistance-arm gearwheel being journalled for rotation on a first end of said bearing support;

a hollow driving spindle providing transmission rotation from said first electric motor to said resistance-arm, wherein on a first end thereof said resistance-arm gearwheel is fixed, and on a second end thereof said resistance-arm is fixed, said first end of said hollow driving spindle being journalled for rotation in said first end of said bearing support;

a second electric motor being mounted transversely of said first electric motor on an opposite side of said plate to provide rotation of said guiding-arm;

a second electric motor spur gear;

a guiding-arm gearwheel being engaged with a train of said second electric motor spur gear, said guiding-arm gearwheel being journalled for rotation on a second end of said bearing support;

a driving shaft providing transmission rotation from said second electric motor to said guiding-arm, said driving shaft extending longitudinally through said bearing support of said driving unit support and said hollow driving spindle, wherein on a first end thereof said guiding-arm gearwheel is fixed and on a second end thereof said guiding-arm is fixed, said first end of said driving shaft being journalled for rotation in said second end of said bearing support;

a gearwheel stop fixed by the screw-thread on said first butt-end of said driving shaft to limit movement of said guiding-arm gearwheel in the axial direction; and a guiding-arm stop fixed by the screw-thread on said second butt-end of said driving shaft to limit movement of said guiding-arm in the axial direction.

5. The training device of claim 4, wherein a multiple reduction gear is used to provide rotation of each of said guiding-arm and said resistance-arm by one of said electric motors.

6. The training device of claim 4, wherein a hollow axle is fixed through a flange on a front-upper, angled, outer structure of said upper house, said hollow axle extending upwards along said rotation axis from said flange and having an inner cylindrical surface fitted to carry a second end of said hollow driving spindle, and an outer cylinder serving as an axle for said resistance-arm.

7. The training device of claim 6, wherein said resistance-arm further comprises a bearing bushing being glued in said axial end thereof, said bearing bushing having an inner cylindrical surface journalled for rotation on said outer cylinder of said hollow axle, said bearing bushing protruding upwards out of said axial end of said resistance-arm and partially out of said hollow axle, thereby forming an outer cylinder, which serves as an axle for said guiding-arm.

8. The training device of claim 7, wherein said guiding-arm further comprises a bearing bushing being glued in said axial end thereof, said bearing bushing having an inner cylindrical surface journalled for rotation on said outer cylinder of said bearing bushing of said resistance-arm.

9. The training device of claim 8, wherein said second end of said driving shaft partially protrudes out of said bearing bushing of said resistance-arm, thereby providing an outer cylindrical surface for placement of a bushing key to engage said driving shaft with said bearing bushing of said guiding-arm.

10. The training device of claim 4, wherein said driving unit further comprises:

a first pre-strained coil spring being mounted on said guiding-arm gearwheel, wherein an inner end thereof is attached to said bearing support and an outer end thereof is attached to said guiding-arm gearwheel, so that said first pre-strained coil spring turns said guiding-arm in the backswing direction, thereby providing a mechanical way for actively guiding of said guiding-arm throughout the backswing, and passive guiding thereof throughout the forward swing;

a one-way stop mechanism being mounted on said plate of said driving unit support to keep said guiding-arm in the golfer's stance position by a stop pin fixed on said guiding-arm gearwheel;

a second pre-strained coil spring being mounted on said resistance-arm gearwheel, wherein an inner end thereof is attached to said bearing support and an outer end thereof is attached to said resistance-arm gearwheel, so that said second pre-strained coil spring turns said resistance-arm in the forward swing direction, thereby providing a mechanical way for actively guiding of said resistance-arm throughout the forward swing, and passively guiding thereof throughout the backswing;

an one-way stop device being mounted on said plate of said driving unit support to limit movement of said resistance-arm at the golfer's stance position by a first stop pin fixed on said resistance-arm gearwheel, when exercising by the user; and an adjustable, one-way stop mechanism being mounted on said cross wall of said driving unit support to stop movement of said resistance-arm in the backswing direction at the end of the backswing by a second stop pin fixed on said resistance-arm gearwheel, when exercising by the user, wherein said adjustable one-way stop mechanism allows the user to adjust a point of the end of the backswing if desired.

11. The training device of claim 10, wherein said one-way stop mechanism for holding said guiding-arm at the golfer's stance position includes:

a moveable catch being moveably positioned in a hollow cylinder which extends upwards from said plate, and which is integral with said plate, said moveable catch having on a first end a vertical surface, which contacts said stop pin of said guiding-arm gearwheel at the golfer's stance position thereof, and an angled surface, said moveable catch having on a second end a lug-hole, and a stop-lug arranged between first and second ends thereof;

a compression spring being positioned on said moveable catch between said stop-lug and a second end thereof to hold said moveable catch in the locking position and allow passing through said stop pin of said guiding-arm gearwheel, when turning it in the forward swing direction, when said stop pin contacting with said angled surface of said first end of said moveable catch; and a hollow spring stop being screwed into said plate which holds said compression spring in said hollow cylinder and allows the moving of said moveable catch.

12. The training device of claim 10, wherein a lockout mechanism is mounted in front-out of said base house on a base edge thereof for releasing said one-way stop mechanism, thereby allowing movements of said guiding-arm in the backswing direction at the beginning of exercising by the user.

13. The training device of claim 12, wherein said lockout mechanism comprises:

a bracket being mounted in front of said base house on said base edge thereof;

a rotatable treadle being hinged on said bracket on an axle thereof being placed closely to the ground, in a fashion such that a pedal of said treadle is biased slightly upwards and a short tail on an opposite end thereof is situated parallel to the ground;

a swinging member being hinged on said bracket over said rotatable treadle, in a fashion such that a first relative short end thereof strokes said short tail of said treadle and an opposite elongated end thereof protrudes through an aperture of base house into interior space thereof; and a control rod being hinged on said second end of said swinging member and coupled with said second end of said moveable catch of said one way mechanism through an axle fixed in said lug-hole thereof, wherein said moveable catch will be moved downward via said control rod, when said user is treading with said user's foot on said pedal, thereby turning said treadle and said swinging member, and correspondingly moving said control rod.

14. The training device of claim 13, wherein said one-way stop mechanism for holding said guiding-arm at the golfer's stance position is a lifting magnet, wherein a moveable core thereof, when being in a closed position, holds said guiding-arm in the golfer's stance position and releases said guiding-arm by actuating an electro-mechanical switch mounted under said pedal of said lockout mechanism.

15. The training device of claim 10, wherein said adjustable, one-way stop mechanism for limiting the movements of said resistance-arm in the backswing direction at the end of the backswing comprises:

a threaded member being positioned on a side of said cross wall of said driving unit support, so that a longitudinal axis thereof is situated tangentially to the trajectory of the movements of said second stop pin of said resistance-arm gearwheel, said threaded member having a head end being rotatably mounted in said tilted wall of said driving unit support and an opposite end being journalled for rotation in a lug arranged on said side of said cross wall;

a stop spring washer fixed on said opposite end of said threaded member to limit movement thereof in the longitudinally direction;

a stop nut screwed on said threaded member, and which protrudes out of said cross wall through an aperture, which is cut through said cross wall between said tilted wall and said lug along said longitudinal axis of said threaded member, thereby providing a contact surface for said stop pin on an opposite side of said cross wall to stop movement of said resistance-arm at the end of the backswing, when exercising by the user; and a demountable elongated control rod having a first end fitted in a hexahedron profile of said head end of said threaded member and a second end protruding out of said upper house on which a handle is fixed, wherein a range of adjustment can be changed by the user, when rotating said threaded member by means of said control rod, thereby changing the position of said stop nut on said threaded member.

16. The training device of claim 1, wherein both of said guiding-arm and said resistance-arm are curved three-dimensionally in order to provide a form of each so as to not interfere with the user's hips and thighs at the golfer's stance, the user's arms and body parts at the end of the backswing, and throughout the forward swing.

17. The training device of claim 1, wherein said second ring of said guiding-arm lead and said resistance-arm finger allow reciprocating movements of said golf club relative to said resistance-arm finger and said distal end of said guiding-arm as the user is swinging said golf club, thereby allowing guiding said golf club along an ellipsoid-trajectory, which is the natural form of the golf swing, by means of both of said guiding-arm and said resistance-arm which rotate around said stationary rotation axis.

18. The training device of claim 1, wherein a length of said resistance-arm finger provides secure contact for said resistance-arm finger with said club shaft at the golfer's stance, and at the end of the backswing, and through the forward swing, thereby allowing guiding said club grip in a swing plane other than said club head swing plane as the user is swinging the club.

19. The training device of claim 1, wherein said trigger mechanism is adjustably mounted on said distal end of said guiding-arm, so that a position thereof can be changed by a user, thereby allowing a user to adjust a height of said swing plane of said club head relative to said housing, said trigger mechanism comprising:

a fork like trigger-head being adjustably screwed on said distal end of said guiding-arm, said fork like trigger-head allowing the user to change a position thereof along said distal end of said guiding-arm, thereby adjusting a height of said swing plane of said club head relative to said housing;

a lifting magnet being mounted in said fork like trigger-head, wherein a moveable core thereof, when being in a closed position, holds said first ring of said guiding-arm lead in said fork like trigger-head; and a lock-nut for locking a position of said fork like trigger-head on said distal end of said guiding-arm.

20. The training device of claim 1, wherein said computer system comprises software actuated switches and electromechanical actuated switches.

* * * * *